United States Patent [19]

Lowin et al.

[11] Patent Number: 4,549,500

[45] Date of Patent: Oct. 29, 1985

[54] PROGRAMMING AID DEVICE

[75] Inventors: Anne-Marie Lowin; Eleanor G. Wight, both of Kingston, N.Y.

[73] Assignee: International Business Machines Corporation, Armonk, N.Y.

[21] Appl. No.: 484,133

[22] Filed: Apr. 12, 1983

[51] Int. Cl.[4] ..... B42D 9/00

[52] U.S. Cl. ..... 116/240; 283/1 A

[58] Field of Search ..... 116/235, 236, 240; 40/341, 352; 434/118, 368, 370, 416; 281/42, 45; 283/1 A, 65; 33/1 B, 1 C, 1 BB, 494

[56] References Cited

U.S. PATENT DOCUMENTS

| | | | |
|---|---|---|---|
| 1,449,045 | 3/1923 | Hollander | 283/65 |
| 2,248,162 | 7/1941 | De Araujo | 283/1 A |
| 2,670,221 | 2/1954 | Wellendorf | 116/240 |
| 3,408,977 | 11/1968 | Colman, Jr. | 116/240 |
| 3,739,739 | 6/1973 | Brase | 116/240 |
| 4,255,653 | 3/1981 | Borkat et al. | 283/1 A |

*Primary Examiner*—Charles Frankfort
*Assistant Examiner*—Patrick Scanlon
*Attorney, Agent, or Firm*—J. W. Henderson; J. Jancin, Jr.; E. Lester

[57] ABSTRACT

A programming aid device for aiding in the interpretation of collimated fields of data in a computer printout. The device includes an inscribed data record which is in a format which corresponds to the collimated fields of the computer printout. When the device is positioned in association with a single row of the computer printout and properly aligned, the data record identifies the data fields of the computer printout. Eyecatcher data is provided in the data record to match up with identical eyecatcher data in the selected row of the computer printout to aid in the alignment of the data record with the selected row of the computer printout. The device also includes an information section for interpreting data in the selected row of the computer printout in accordance with designator data associated with predetermined fields of the data record.

13 Claims, 13 Drawing Figures

FIG. 1

| | |
|---|---|
| FIG. 1A | FIG. 1B |
| FIG. 1C | FIG. 1D |

FIG. 4

| | |
|---|---|
| FIG. 4A | FIG. 4B |
| FIG. 4C | FIG. 4D |

SSCP-PU Only Input Types (PNKINPUT)

- A ACTPU Request Received
- B DACTPU Request Received
- C CONTACT Request Received
- D DISCONTACT Request Received PLU-SSCP and PLU-SLU Input Types (PIBINPUT/SIBINPUT)

- A BIND Response Received
- B SDT Response Received
- C Data-In Received
- D UNBIND Response Received
- E Shutdown Request Received
- F UNBIND Request Received
- 10 LU Status Request Received
- 11 Signal Request Received
- 12 Chase Request Received
- 13 Pace Response Received
- 14 —RSP Resynchronization Required
- 15 Clear Response Received
- 16 Bid Response Received
- 17 RTR Request Received
- 18 Cancel Received PLU-SLU Only Input Types (SIBINPUT)

- 1D Data-Out Received (CXRSOUT)
- 1E Bracketing Error Detected (CXRPCHK)
- 1F Chaining Error Detected (CXRPCHK)
- 20 Null RU Received (CXRPCHK)
- 21 Pacing Error (CXRPACI)
- 22 Ignore Condition Detected (CXRPCHK)
- 23 Logoff Condition Detected (CXRPINX)
- 24 Chaining Not Supported (CXRPCHK)

PLU-SSCP Only Input Types (PIBINPUT)

- 1D ACTLU Request Received
- 1E DACTLU Request Received
- 1F CINIT Request Received
- 20 CTERM Request Received
- 21 CLEANUP Request Received

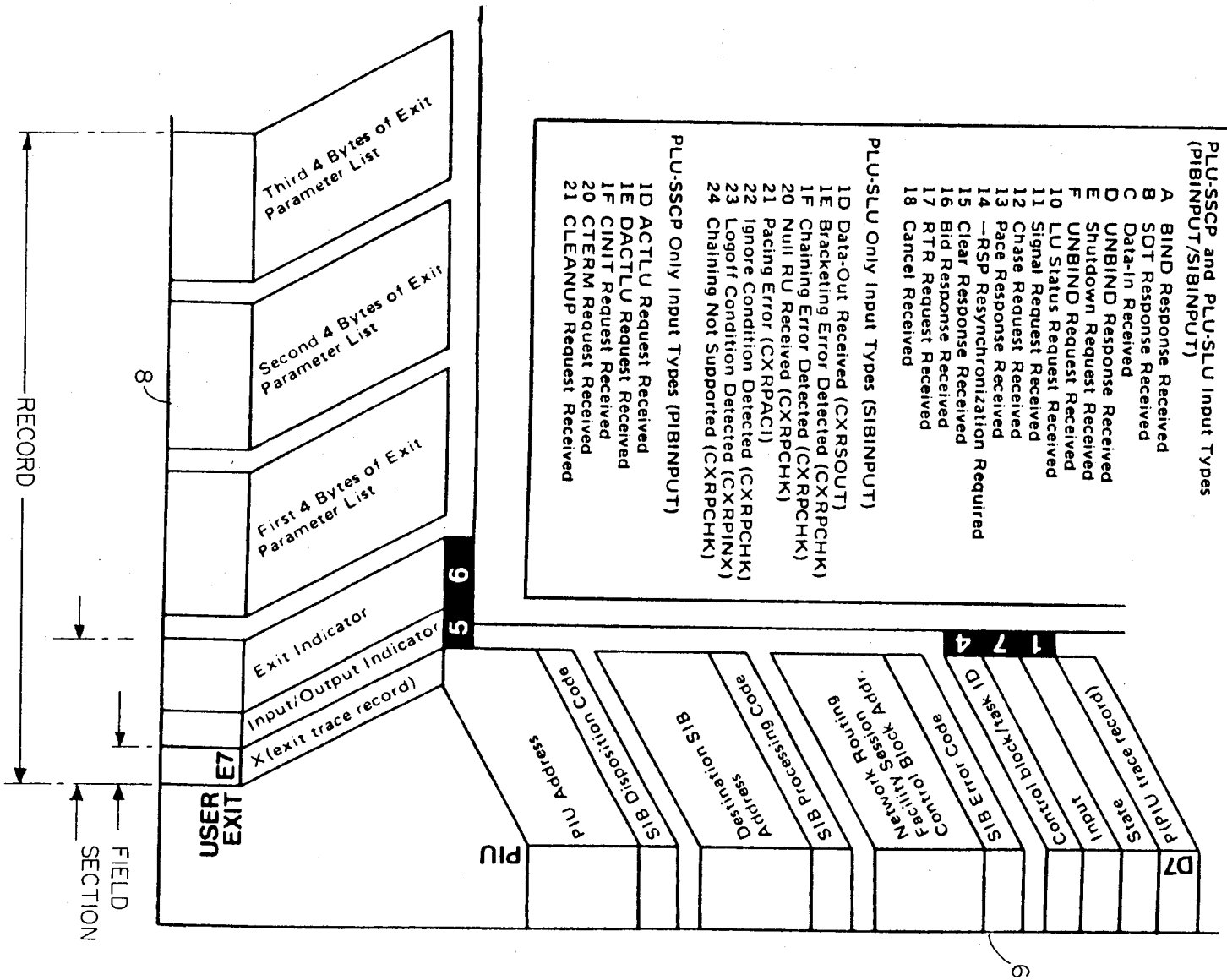

FIG. 1D

22

Channel Status Word (from IOSB)

1 NCB Type

06 ICNCB
07 LDNCB
FE XCNCB

2 State for NCB Type = 06 or 07

00 Reset
01 Sense pending
02 WXID pending
03 XID pending
04 CONTACT or ACTLINK pending
05 Contacted or Active
06 Discontact or DACTLINK pending
07 Contacted, but not active (CTCA)
11 Load Pending
14 Loading
15 Dump pending
18 Dumping
87 Response pending for DISCONTACT or NOP
8B DISCONTACT response pending for Contacted 02
8D DISCONTACT response pending for Contacted 03
8F DISCONTACT response pending for Contacted 05
92 NOP response pending for Load
96 NOP response pending for Dump
C8 OBR pending for DISCONTACT or DACTLINK
C9 OBR pending for Station INOP
CA OBR pending for Link INOP
CC OBR pending for Contacted 02
CE OBR pending for Contacted 03
D0 OBR pending for Contacted 05
D3 OBR pending for Load
D7 OBR pending for Dump

34

24

Request Unit

Sense (RUPESNS) 8

2 State for NCB Type = FE

00 Reset
01 X-side: I/O pending
02 Y-side: I/O pending
03 CONTACT.WAIT
04 CONTACT.WAIT.DCM
05 XID7 #1 pending
06 XID7 #2 pending
07 XID.BAD pending
08 XID7 #1 I/O pending
09 XID7 #2 I/O pending
0A XID.BAD I/O pending
0B Ready
0C Discontact scheduled
0D HDV pending
0E HDV pending DCM
0F Pending Discontact

3 NCB Flags

Byte 1:
80 Device is busy
40 Channel end appendage
lock for change of control
20 Read required
10 Write required
08 Half session is held
04 Slowdown mode
02 Ignore an asynchronous device end after a unit end
01 VR flow control check is required Byte 2:
80 Asynchronous interrupt during I/O
40 I/O error message
20 Delayed Read required
10 Request connection
08 I/O trace active for this node
04 Start I/O counter overflow indicator
02 Halt I/O is required
01 Halt I/O issued

36

26

RDTE State 12

CPCB WTD Word 1 13

Byte 1:
80 ERP in progress
40 Channel end appendage entered for error retry
20 Channel end appendage entered for permanent error
10 Attention intercept condition in progress
08 Attention intercept logging in progress
04 Should-not-occur condition detected
02 SYSGENs-do-not-agree condition detected
01 Deferred status interrupt; CSW status not set; leave previous CSW Byte 4:
80 Polling in progress
40 Virtual machine
20 INN traffic is waiting for this node to exit slowdown
10 Migration node; if no 10, node is not a migration node
08 Link INOP detected
04 Station INOP detected
02 Closedown recording in progress
01 DACTLINK in progress

4 I/O Compl. Code

IOSCOD field in MVS IOSB
71 Hardware corrected data check for fetch
74 The I/O request has been routed to I/O restart by CCW, alternate CPU recovery, or missing interrupt handler for processing
7E Intercept condition

38

28

FIG. 4B

40

| SSCP (not NCSPL or RUPE) | C3C3C9 CCI C3C3D6 CCO | RU Flags 6 | ASID | Return Address (Issuer) | CBID | Save Area Address | Save Area ID 7 | CPCB Word 1 14 | CPCB Op Code 11 |
|---|---|---|---|---|---|---|---|---|---|

30

42

7 Save Area ID
Module Name
Bytes 4, 5, 7, and 8 (if available)

8 RUPE Sense Bytes (RUPESNS)
See "Appendix A" in ACF/VTAM Diagnosis Guide.

9 CPCB Flags (NCSFLAGS)
80 NCSPL was not obtained dynamically
40 NCSPL obtained by REQSTOR
20 NCSPL is in ACF/VTAM private storage
10 Do not address RDT segment

10 CPCB Return Code (NCSIORC)
General Codes:
00 Command processed successfully
04 NCP active, load not performed
08 I/O purged
0C Command failed
10 Reload declined by operator
14 Dump complete
18 Command rejected, HALT in progress
1C Command not recognized
20 Command rejected, insufficient storage Dial Operation Codes
00 Dial-out successful
04 Dial-out not successful
08 Dial-out pending
00 Dial Contact, Loaded
0C Dial Contact failed
00 Dial-Abandon Connection complete
00 Enable Answer complete
04 Offhook required
08 Enable Answer failed
28 PU powered off I/O or Restart Codes
00 I/O successful
00 Restart successful
00 IPL No Restart on Vary

32

44

13 CPCB's WTD (cont.)
07 TPQUE first as a response; next 3 bytes point to PAB
80 Next 3 bytes point to an RPH with FREEAREA option
82 Next 3 bytes point to an ECB with FREEAREA option
FF Do nothing; no Notify

14 CPCB Word 1
Byte 1:
50 CPCB is prefix of an ISTDLRPL
54 CPCB is prefix of an ISTRUPE
57 CPCB is prefix of an ISTPPL
58 CPCB is related to an ISTTQE
5F CPCB by itself
60 CPCB is prefix of an ISTNCSPL
98 CPCB is related to an ISTSIB Byte 2:
nn Length of control block in which the CPCB is imbedded; if 34, the CPCB is not being used as a prefix.

Byte 3 (CPCB Flags):
80 Static flag
40 REQSTORed
20 In ACF/VTAM private storage
10 TPEXIT NONE flag
08 Inbound (reply)
04 Defer exit
02 CPXCTL function flag
01 CPCALL NO WAIT function flag Byte 4 (CPCB Return Code):
00 Successful
03 Migration node encountered
04 Not successful (negative response)
04 370x already loaded
08 Not successful, request purged
0C I/O error for 370x load

FIG. 4C

CPCB WTD Word 1 — 13

CPCB Word 4 — 15 before entrance to error routine
7F Normal completion
6D Post status goto ABE and ERP
41 Permanent I/O error
42 Extent error
43 Duplexed I/O request was not started because of a quiesced or not ready device
44 Request was intercepted because a permanent error occurred the last time that the device was used
45 I/O request abnormally terminated because of program check, machine check, etc., in IOS or appendage
48 Purged request
4B Error in tape repositioning
4C Invalid exposure number
4D CC=3 GDP or NIP in control
4E GDP reserved device or, in conjunction with IOSRELSE, device cannot be released
4F GDP CPU offline
51 The I/O device has been declared in permanent error after ERP processing and I/O restart

5 Sense Data

IOSSNS field in MVS IOSB
10FE Value supplied for unsuccessful sense
nnnn See "Appendix A" in ACF/VTAM Diagnosis Guide.

6 RU Flags

80 Response RU
40 Sense included
00 Request RU

40

Activate command
00 IPL successful
04 I/O error
04 Restart error
04 Remote NCP already active
08 I/O purged
08 Warm start failure for Vary Activate
08 NCP size too large
0C IPL failed on Vary Activate
0C I/O error on remote IPL
10 IPL successful, no restart available on Vary Activate
14 Invalid address specified on Display Storage command
2C Half a dump record
40 Dynamic dump complete, requested storage address exceeded NCP size
44 3725 diskette empty
70 Remote power off Display Storage Codes
04 Fail other than prior deactivate
0C Prior deactivate

11 CPCB Operation Code

See "Appendix C" in ACF/VTAM Diagnosis Guide.

12 RDTE State

See "Appendix B" in ACF/VTAM Diagnosis Guide.

13 CPCB's WTD Word 1

Byte 1:
00 TPPOST the RPH; next 3 bytes point to RPH
01 TPQUE as a resource to the PAB; next 3 bytes point to PAB
02 VPOST the ECB; next 3 bytes point to ECB
03 TPQUE chain to the TIL and VPOST its ECB; next 3 bytes point to TIL
04 TPQUE as a request to the PAB; next 3 bytes point to PAB
05 Send a response
06 Call a module

30

42

32

10 Timing conflict, reissue request
14 Not successful, overridden by another request
14 370x dump completed
18 Not successful, halted
1C Not successful, request not recognized
20 Not successful, no storage available
24 Activate remote failed, remote in tact
40 Dynamic dump completed
AB Not successful, ended

15 CPCB Word 4

Byte 1:
80 Inquire OPTCD=LOGONMSG
40 Inquire OPTCD=DEVCHAR
20 Inquire OPTCD=TERMS
10 Inquire OPTCD=COUNTS
08 Inquire OPTCD=APPSTAT
04 Inquire OPTCD=RNNAME
02 Inquire OPTCD=CIDXLATE
01 Inquire OPTCD=TOPLOGON Byte 2:
80 Inquire for BSC ID
40 Inquire for display command
20 Inquire OPTCD=SESSPARM
10 Inquire OPTCD=SESSKEY Byte 3:
80 SETLOGON QUIESCE
40 SETLOGON START
20 SETLOGON STOP Byte 4:
40 Receive keep
20 Receive truncate
10 Receive NIBTK
01 FMHDR required; if no 01, no FMHDR

44

FIG. 4D

PROGRAMMING AID DEVICE

BACKGROUND OF THE INVENTION

This invention relates to a programming aid device for computer output and, more specifically, to a device for aiding in the interpretation of fields of data in a computer programming printout.

One of the problems in making problem determinations with respect to computer printouts is to be able to rapidly select a particular row of the computer printout and then to interpret the hexidecimal (hex) characters of the record contained in the selected row. Heretofore, masking devices have been employed containing one or more clear transparent slots through which exposed rows of character printout may be viewed. These devices are moved over a sheet of computer printout to block out printed matter, except that of the row to be selected. An objection to this type of device is the difficulty in locating the desired row due to obscuring the reference material above and below the row to be viewed. Another type of prior masking device shown in U.S. Pat. No. 3,739,739 provides lightly tinted areas adjacent to a clear transparent slot to allow viewing rows adjacent to the desired row and thereby aid in rapidly selecting the desired row. However, in both cases, the device is merely an aid in selecting the desired row of the computer printout. To interpret the hex characters of the record in the selected row, the user would have to first look up information pertaining to the format of the selected record, then obtain an offset value to locate the particular field of interest in the selected record, count over to the offset, read off the value in the particular field and again look up information to interpret that field. This interpretive information may span many pages of a manual and be co-mingled with a lot of other information. The user might have to keep his fingers in several places within a manual to make sense of the information in the computer printout. The problem determination effort then becomes time consuming and is susceptible to error in interpretation because of having to look in many different places for the information. Another type of masking device that has been employed is illustrated in the IBM 8100 Information System distributed Procesing Programming Executive Base Problem Determination Reference Summary, Form No. SX27-0026-0 published in May 1980. This device consists of a paper template, the edge of which acts as a straight edge and the body of which acts as a blind to block out undesired rows of the computer printout. The template is formed as a multi-page foldout from a manual which makes it awkward for use in scanning the rows of a computer printout. A portion of a record format is printed on one edge of the paper foldout and the fields along the edge are used to exactly match the fields of the computer printout. Interpretive data is provided on different folds of the paper template pointed to by arrow directed lines which criss-cross each other to tables of data. Again, such an arrangement is awkward and confusing and does not make for ease of use. Likewise, there is no easy eye-catching way of lining up the edge of the template with the computer printout.

SUMMARY OF THE INVENTION

Accordingly, it is an object of the invention to provide a simple programming aid device which can be moved quickly and easily through computer printouts to select a desired row for examination.

Another object of the invention is to provide a programming aid device which contains eyecatcher data that allows a quick alignment of record format data on the device to be matched up with data fields of a computer printout.

A further object of the invention is to provide a programming aid device which contains a preset data field or fields that allows a rapid alignment of the data field or fields on the device to be matched up with a data field or fields of the computer printout under examination.

Still another object of the invention is to provide a template which makes reading and interpreting computer printout information faster and less prone to error.

Still a further object of the invention is to provide a template having record fields and captions which make reading computer printout information easier, faster and more accurate.

Still another object of the invention is to provide a programming aid device which includes designator values associated with record field captions to direct the user to interpretation data for computer printout.

In accordance with the present invention, a programming aid device is provided which comprises a flexible card having record and interpretative data inscribed on the card. Each record on the card is formatted into sections of collimated fields of data corresponding to sections of collimated fields of computer printout. With this arrangement, when the card is positioned along a selected row of computer printout, the sections of collimated fields of data on the card align with and identify the record fields of data in the selected row of the computer printout. To aid the alignment of the record data on the card with the record data of the selected row of computer printout, eyecatcher data, in the form of hexidecimal characters, is provided at the beginning of the first data field of the first section of a record on the card to correspond to identical data at the beginning of the first data field of the record in the selected row of computer printout. Other fixed data characters which are known to always appear in a data field of a computer record printout may also be preset on the corresponding data field on the card. Accordingly, because the preset data characters on the card will be identical and correspond to the fixed data characters in a field of computer record printout, these preset data characters also act as eyecatchers to aid the alignment of the card record with the computer printout record. Descriptive captions are provided for each field on the card and are arranged so that they describe the computer printout fields to which they visually relate. Designator numbers are centered below certain descriptive captions to designate corresponding number tables of information, found elsewhere on the card, which contain unique information that is determined by the particular program for which the card is created. The tables of information each contain a column of hex characters corresponding to the hex characters which appear in the data fields associated with the designator numbers and are each followed by a brief description of the meaning of the hex characters.

The foregoing and other objects, features and advantages of the invention will be apparent from the following particular description of a preferred embodiment of the invention, as illustrated in the accompanying drawings.

BRIEF DESCRIPTION OF THE DRAWINGS

FIGS. 1A–1D taken together as in FIG. 1, constitute a plan view of a programming aid device for reading and interpreting computer printout data.

FIGS. 4A–4D, taken together as in FIG. 4, constitute a plan view of an alternative embodiment of the programming aid device for reading and interpreting computer printout data.

DETAILED DESCRIPTION

Figure 1A:
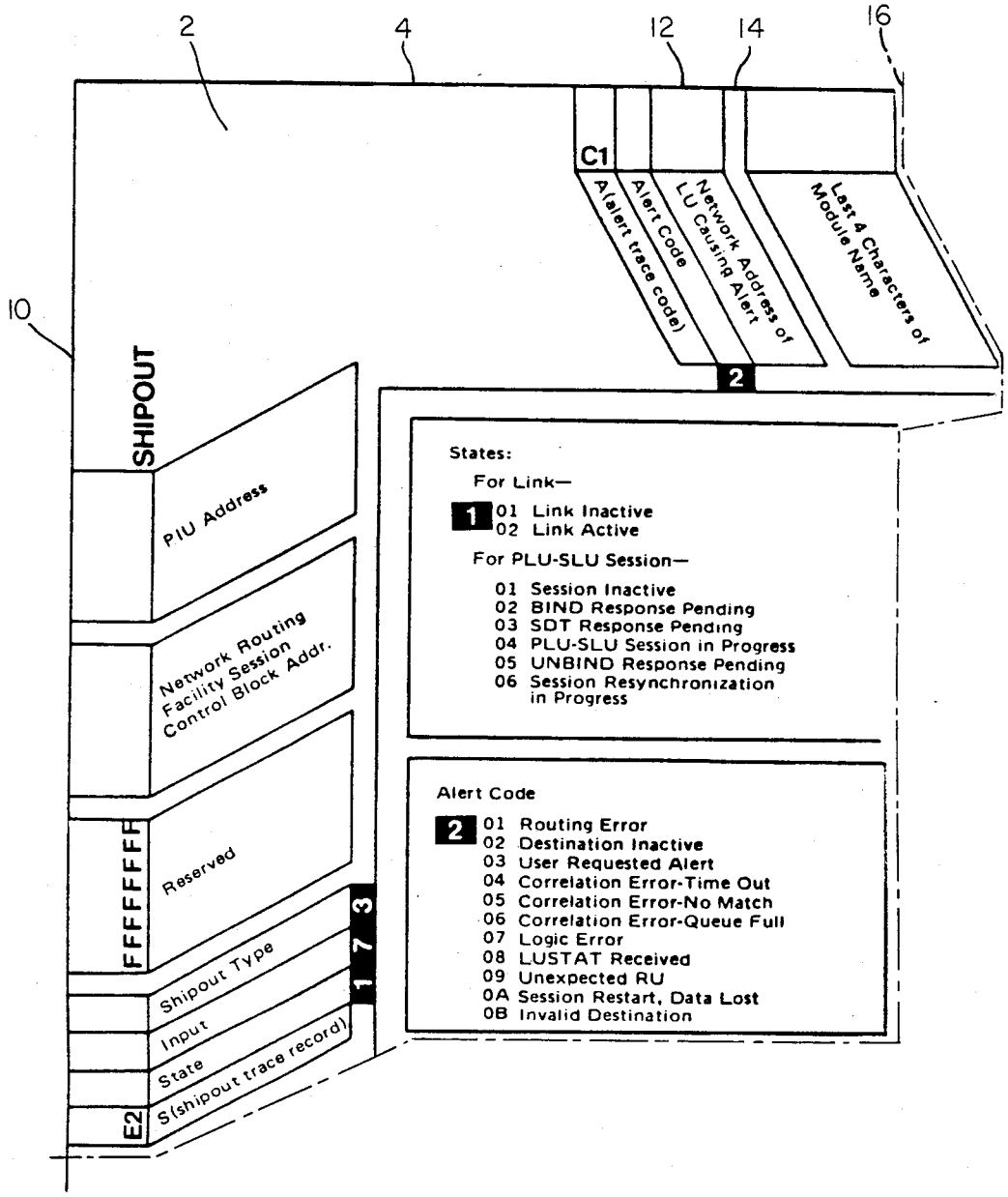
Figure 1B:
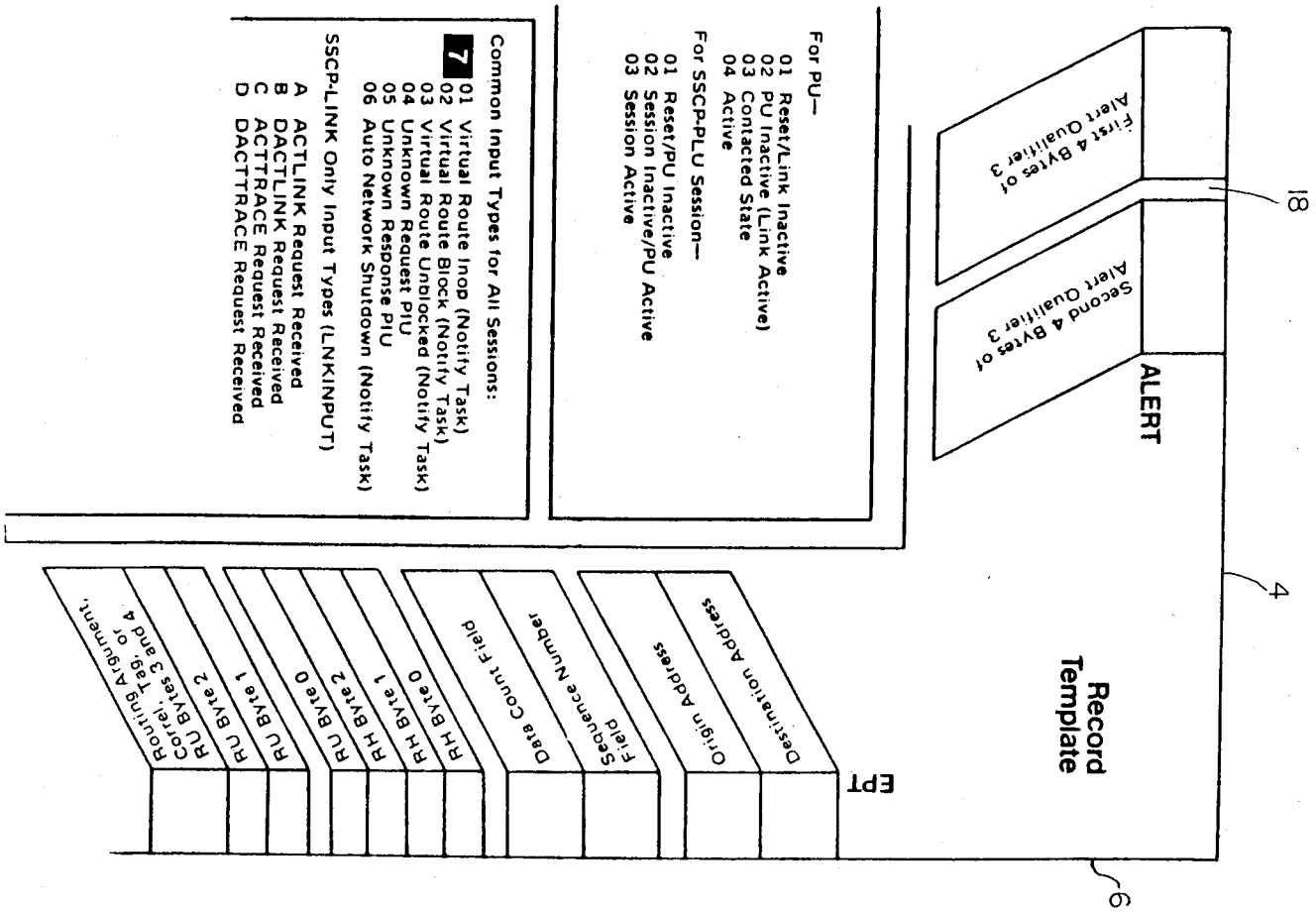
Figure 1C:
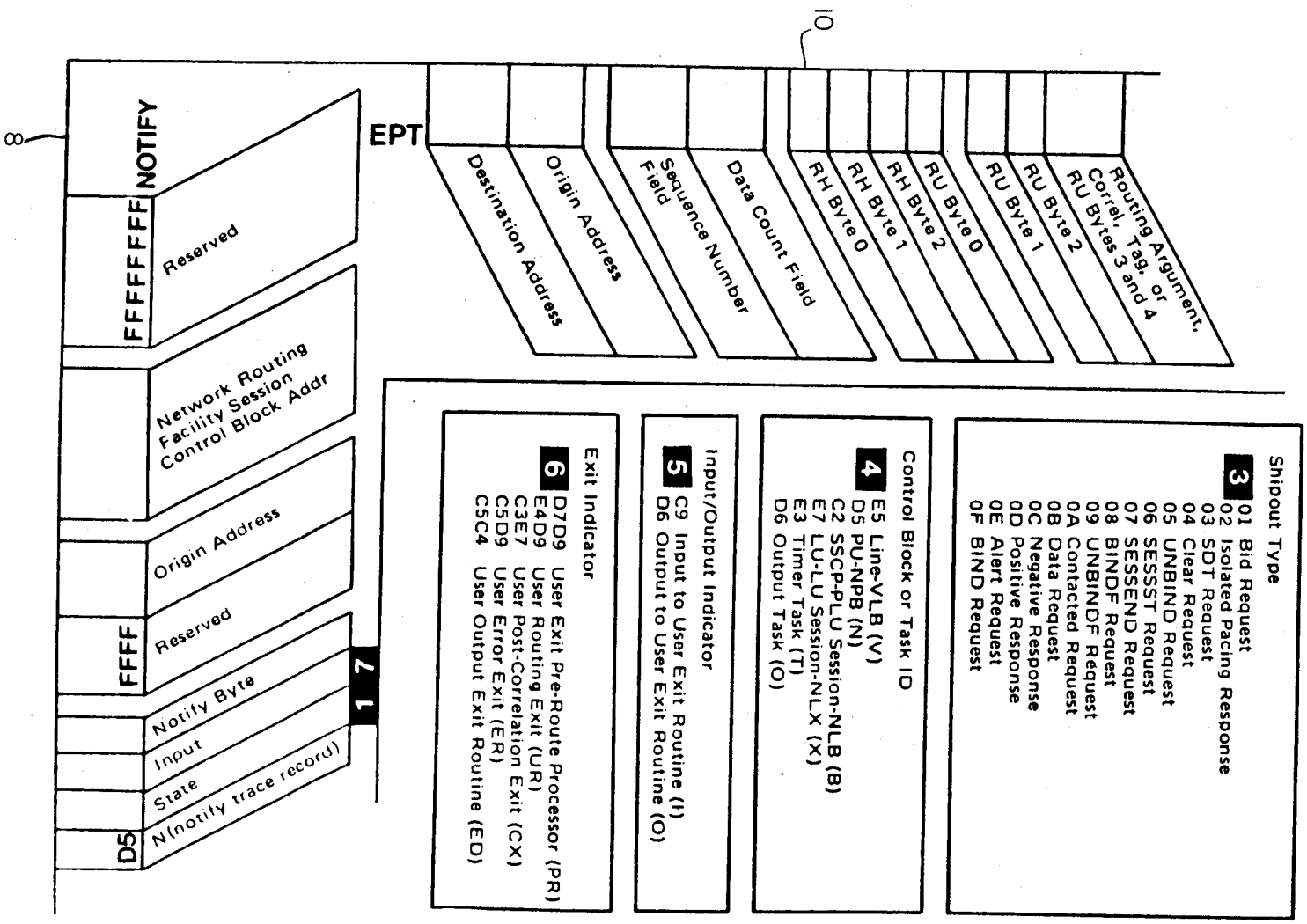

Referring to FIG. 1, there is illustrated a programming aid device which comprises a flexible card template 2 of a size that fits the needs of a particular program information with which it is to be used. The card may consist of opaque 50# paper, varnished or plastic-coated cover stock, or plastic or vinyl card stock material. Thus, a representative programming aid device may consist of a vinyl card that is $8\frac{1}{2}\times 11$ inches. The edges of the template card 2 act as a straight edge for locating a desired row of computer printout information. One or two record formats are inscribed, in ruled form, along each edge of the card. Thus, edge 4 (FIGS. 1A and 1B) has one ruled record format while edges 6 (FIGS. 1B and 1D), 8 (FIGS. 1C and 1D), and 10 (FIGS. 1A and 1C) each have two ruled record formats. The space between ruled lines, e.g., space 12 FIG. 1A, defines a field of hex characters in the computer printout while a series of fields bounded by spaces constitutes a section of the record. The spaces between sections of the record, e.g., spaces 14, 6 and 18 (FIGS. 1A and 1B)), are left blank to allow matching exactly the spaces between sections of the computer printout to be scanned. Eyecatacher data, i.e., hex characters that always appear in a field, are shown within the field, right-reading, directly below the exact position where they would appear in a row of computer printout, e.g., C1 always appears in the first field of the record format along edge 4 of the card 2 (FIG. 1A). Other hex characters that always appear in a field or fields other than the first field may also be shown within the field, directly below the exact position where they would appear in the row of computer printout, e.g., the row of hex F characters in the two fields of the record shown along edge 8 of the card 2 (FIG. 1C). Thus, these eyecatcher data characters may be permanently preset on the card 2 and may be used as an aid in aligning a record format on the card with a computer printout record.

Lines are ruled at 90° to the edge of the card and are used to delineate fields of the record format on the card. The lines are angled away from the record format at about a 30° angle and descriptive captions are given in slanted type between the angled lines to relate them visually to the fields they describe. The descriptive captions tell the user what the hex characters in the field mean, i.e., in the ALERT record format (FIGS. 1A and 1B), the four hex characters in the third field of the computer printout record represent the network address of the logic unit causing the alert.

Designator numbers are centered below certain descriptive captions to designate corresponding numbered tables of information, centered on the card, which contain unique information that is determined by the particular program for which the card is created. The tables of information each contain a column of hex characters corresponding to the hex characters of the computer printout which appear in the data field associated with the designated number and are each followed by a brief description of the meaning of the hex characters in that particular field of data. Thus, the delineated fields of data and descriptive captions make reading the computer printout data much easier, much faster and more accurate. Also, the cross-referenced information in the tables identified by the designator numbers saves the user from having to find the information on several pages of a manual or, perhaps, in several manuals.

Figure 2:
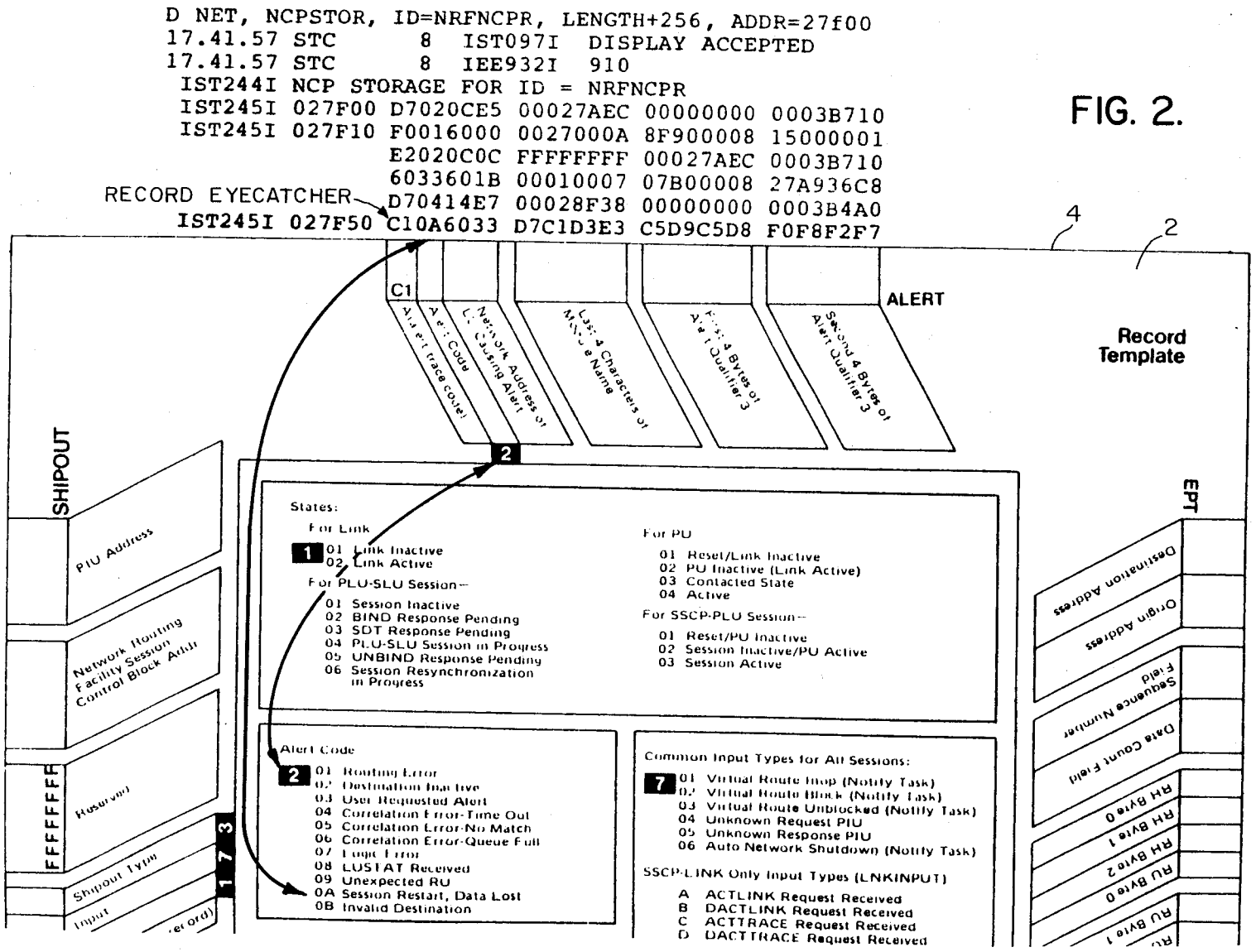
FIG. 2 is a plan view of the aid device shown in position over a portion of a computer printout.

When using the programming aid device of the present invention, the template card 2 is laid against the computer printout and quickly moved through the printout to a selected row. The blank spaces between sections of the record format on the card 2 are aligned with the spaces between sections of the computer printout and the hex character eyecatcher data or other preset data on the card 2 is also matched to the same eyecatcher data on the computer printout. Referring to FIG. 2, the programming aid device is shown with edge 4 being positioned below a selected row of computer printout. It should be noted that the template card 2 blocks all of the print data below the selected row and helps the user focus on the single row of computer output. It should also be noted that the spaces between sections of the record format on the card 2 are matched exactly with the spaces between sections of the computer printout record. Further, it should be noted that the eyecatcher data C1 in the first field of the first section of the record format matches exactly with the C1 of the computer printout record. Having lined up the record format on the card 2 with the computer printout, it is noted that a designator number is provided beneath the second field of the record format and designates table 2 of the tables of information provided on the card. The meaning of the hex characters in that field of the computer printout record may now be interpreted by the brief description in the table at the entry associated with the hex characters. Thus, the hex characters 0A in the computer printout may now be interpreted according to the 0A in table 2. This description eliminates the need for the user to search many pages within a manual or even pages of several manuals, for the meaning of these codes.

Figure 3:
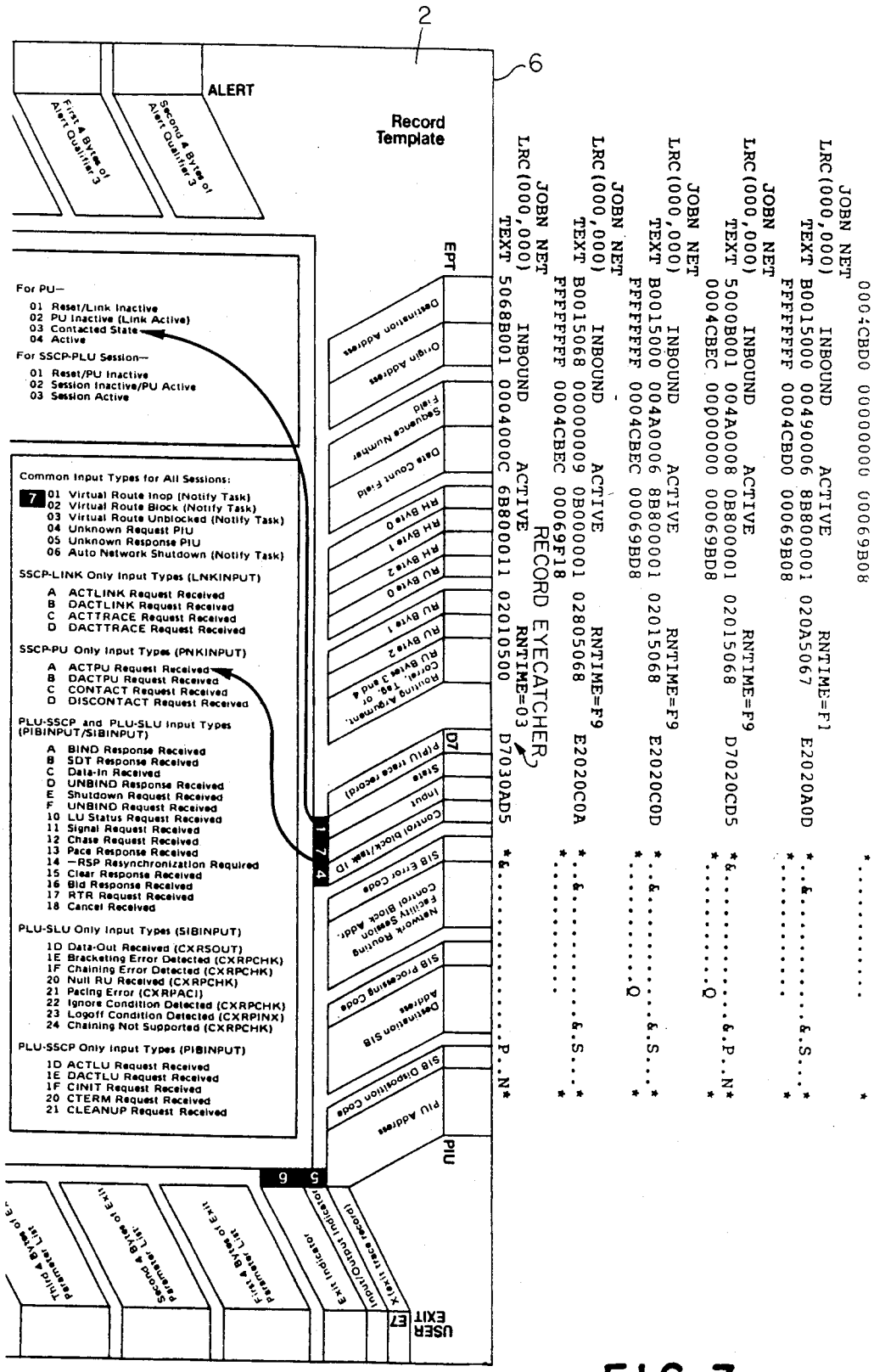
FIG. 3 is a plan view of the aid device shown in position over another portion of a computer printout.

Referring now to FIG. 3, the programming aid device is shown with the edge 6 being positioned below a selected row of computer printout. Here again, the spaces between sections of the record format on the card are lined up with the spaces between sections of the computer printout record and the eyecatcher data in the first field of the record format on the card 2, i.e., D7, matches identically with the same eyecatcher data in the first field of the computer printout record. With the record format of the card 2 being properly aligned with the computer printout record, the hex characters in the second, third and fourth fields of data of the firt section are to be interpreted in accordance with the designator numbers 1, 7 and 4 visually shown as being associated with those fields. However, referring to tables 1 and 7, it is noted that there are identical entries in several subtables for the hex characters 03 and 0A. Therefore, it is necessary to provide information as to which subtable is to be used to interpret the hex characters of those fields. Accordingly, the user must first view the fourth field associated with the designator number 4 and which contains the descriptive caption designated Control Block or Task ID. The hex characters, D5, in the fourth field of the first section of the computer printout record is interpreted as a PU entry in table 4 as shown in FIG. 1C. Therefore, the hex characters 03 and 0A in the second and third fields, respectively, of the first section of the computer printout record may be interpreted by corresponding entries in the PU subtables of tables 1 and 7, respectively, as shown in FIG. 3. Thus, for these type of records, the user quickly learns to read the fourth field of a PIU record before looking at the second and third fields of the record, i.e., the interpretations to be given to the entries in the second and third fields of such a record are dependent upon the setting of the fourth field.

It should be apparent that the programming aid device of the present invention can be moved through computer printout records quickly and easily because the device matches the size and layout of the printed records. The device also makes reading and interpreting information faster and less prone to errors. The formation contained on the card summarizes data which might otherwise be contained on many non-continuous pages of a manual. The mechanics of scanning computer printout record information, finding data of importance and interpreting that data with the aid device is much faster than with traditional manual documentation techniques.

When the record formats for a program are relatively few in number, the programming aid device fo FIG. 1 is suitable for use in scanning and analyzing computer printout records. However, as programs grow in size and complexity, the number of record formats used by the program increases proportionately and it is not possible, because of the limited number of sides of the record template card, to continue using a single card to accommodate all the different formats required by larger programs. Accordingly, referring to FIG. 4, there is shown an alternative embodiment of the present invention which will accommodate a greater number of record formats on a single card without losing any of the advantages of the embodiment shown in FIG. 1.

Figure 4A:
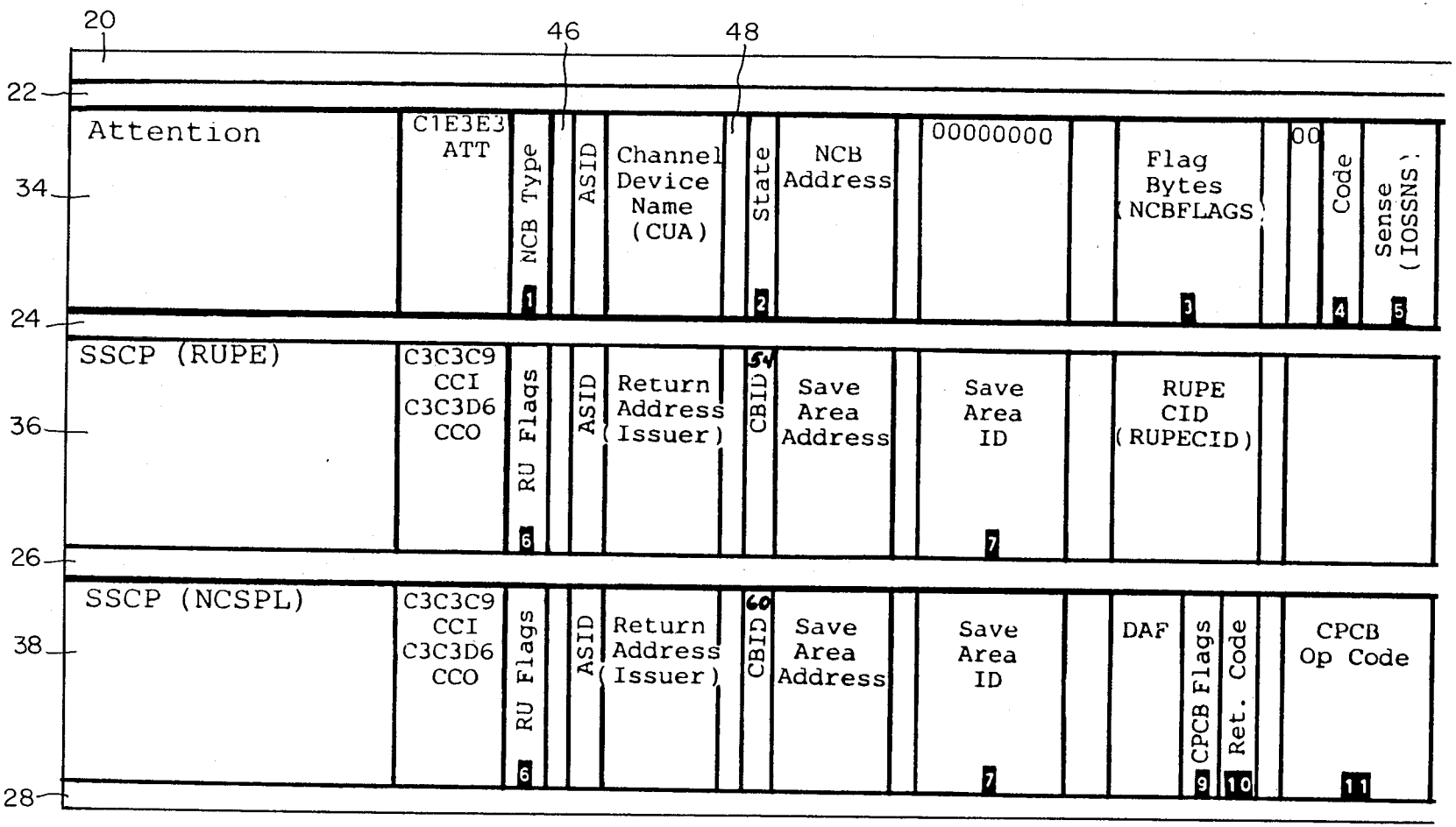

The programming aid device of FIG. 4 also comprises a flexible card 20 formed with a series of clear transparent slots 22, 24, 26, 28 (FIGS. 4A and 4B), 30 and 32 (FIGS. 4C and 4D) extending longitudinally of the card and parallel to each other. The spacing between the edges of each of these slots is such that it is slightly larger than the height of the characters of the computer printout record and therefore, when the card is positioned on a computer printout, a single row of the computer printout will be visible through each transparent slot. The areas 34, 36, 38 (FIGS. 4A and 4B), 40, 42 and 44 FIG. 4C and 4D between the slots are relatively wide compared to the width of the slots and are of an opaque color to block out non-selected rows of the computer printout.

Vertical lines are ruled from the lower edge of one slot to the upper edge of the next succeeding lower slot. These lines are ruled at 90° to the edges of the slots and serve to delineate fields of hex characters in the computer printout. Descriptive captions are provided between the ruled vertical lines to relate them visually to the fields they describe. A series of captioned fields bounded by non-captioned spaces, such as spaces 46 and 48, (FIG. 4A), constitute a section of the record. The spaces between sections of the record are left blank to allow matching exactly the space between sections of the computer printout.

Eyecatcher data is provided in the first field of data of each record format, directly below the exact position where it would appear in a row of computer printout. Thus, for example, the hex characters C1E3E3 always appear in the first field of a computer printout record having an ATT record format (FIG. 4A). The name of the record format type, e.g. ATT, is also carried in the first field of the printout record below the hex characters. The presence of the latter type of information is used to aid in selecting the row of printout data to be examined as will be later explained. Hex characters that always appear in another field or other fields may be present on the card directly below the exact position where they would appear in the printout record, e.g., the series of 0's in the fourth section of the ATT record may be permanently preset on the card and used as an aid in aligning the card record format with the computer printout record.

Designator numbers are centered below certain descriptive captions to designate corresponding numbered tables of information found elsewhere on the card which contain unique information determined by the particular program being used with the programming device. The tables of information, as in the earlier version of the programming aid device, each contain a column of hex characters corresponding to the hex characters of the computer printout and are each followed by a brief description of the meaning of the hex characters in that particular field of data. Thus, here again, the delineated fields of data, the descriptive captions and the cross-referenced information in the tables identified by the designator numbers make reading and interpreting the computer printout much easier, faster and more accurate.

Figure 5:
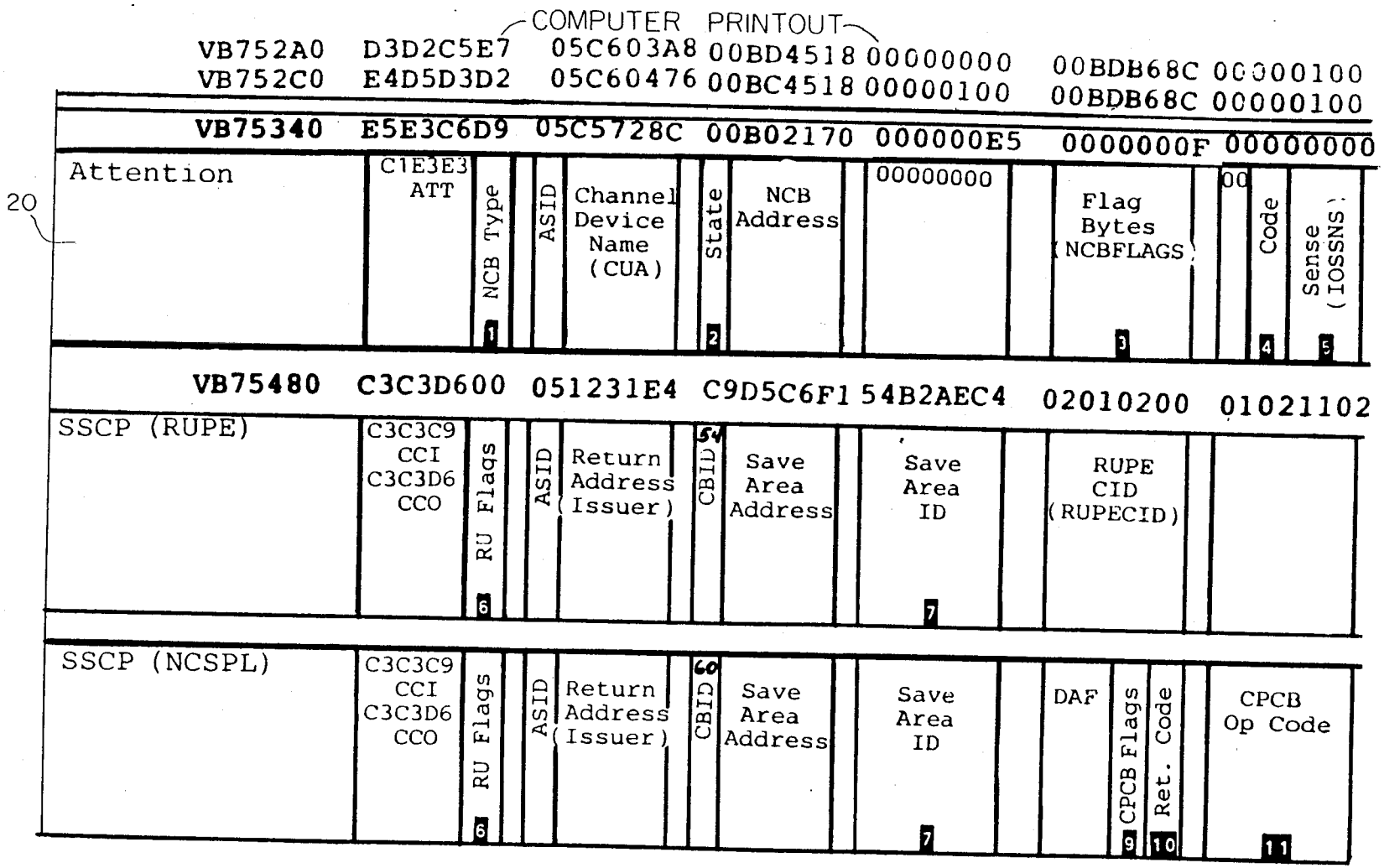
FIG. 5 is a plan view of the aid device shown in FIG. 4 in position over a portion of a computer printout.

Referring now to FIG. 5, when using the programming aid device 20, it is laid against the computer printout to be examined and quickly moved to a selected row. The blank spaces between sections of the record format of the card and the eyecatcher or other preset data on the card is used to aid in aligning the record format with the computer printout. The record format type printed in the first field of a record format on the card 20 and positioned beneath the eyecatcher hex characters also serves as eyecatcher data in selecting a computer printout record. Thus, each row of the computer printout includes a codal representation of the record format type, and as the card is moved across the computer printout, the codal representation in the printout may be visually compared against the record format type contained in the first field of the record format on the card until a match is found identifying the selected row. Thus, by using codal representations of the computer record format, spaces between sections of the record and other eyecatcher data, the selection, reading and interpreting of computer printout records is made easier, faster and more accurate than has heretofore been attained. It should be appreciated that the opposite side of the template cards can also be used for additional record formats and would likewise have ruled lines, eyecatcher and preset data, descriptive captions, designator numbers and table of interpretative information for the further election, reading and interpretation of computer printout records.

While the invention has been particularly shown and described with reference to preferred embodiments thereof, it will be understood by those skilled in the art that various changes in form and detail may be made therein without departing from the spirit and scope of the invention.

Having thus described our invention, what we claim as new and desire to secure by Letters Patent is:

1. A device for aiding in the interpretation of collimated fields of data in a printed computer output comprising;

a data record inscribed on said device and being in a predetermined form correspoding to said collimated fields so that the data record aligns with and identifies data fields in a single row of said collimated fields of data when said device is positioned in association with said single row of said computer output;

said data record including predetermined eyecatcher data to match against eyecatcher data in a selected single row of computer output to aid in aligning said data record with said selected single row of computer output, and an information section used for interpreting data in said selected single row of said collimated fields of data as identified by predetermined fields of said data record.

2. The device of claim 1 wherein said data record further includes a preset data field which corresponds identically to a predetermined one of said data fields in said selected single row of computer output to further aid in the alignment of said data record with said selected single row of computer output.

3. The device of claim 1 wherein said data record further includes a series of preset data fields which correspond identically to predetermined ones of said data fields in said selected single row of computer output to further aid in aligning said data record with said selected single row of computer output.

4. The device of claim 1 wherein the eyecatcher data of said data record is positioned in said data record to match identically with eyecatcher data positioned in the first data field of said selected single row of computer output.

5. The device of claim 1 wherein said data record further includes descriptor captions for each field of the data record so that when the data record is aligned with said selected single row of said computer output said captions identify each field of said computer output.

6. A device for aiding in the interpretating of record data in a printed computer output which is sectionalized into collimated fields of data comprising;

a flexible sheet member, said member including a data record inscribed thereon with said data record being sectionalized into fields corresponding to the fields of said computer output so that the fields on said member align with the fields of said computer output and identify the record data in a selected single row of said computer output when the member is positioned in association with said single row of said computer output, said data record on said member including predetermined eyecatcher data which corresponds identically to data in said selected single row of computer output to aid in aligning the data record on the member with said selected single row of computer output, and an information section inscribed on said member for interpreting data in said selected single row of said collimated fields of data as identified by predetermined fields of said data record.

7. A device for aiding in the interpretation of collimated fields of data in a printed computer output comprising;

a data record inscribed on said device and being in a predetermined form corresponding to said collimated fields so that the data record aligns with and identifies data fields in a selected single row of said collimated fields of data when said device is positioned in association with said single row of said computer output;

said data record including predetermined eyecatcher data to match against eyecatcher data in said selected single row of computer output;

designator data inscribed on said device and associated with predetermined fields of said data record, and an information section inscribed on said device for interpreting data in said single row of said collimated fields of data as identified by said designator data.

8. The device of claim 7 wherein said device comprises a flexible card and said data record being inscribed along an edge of said card.

9. The device of claim 7 wherein said device comprises a flexible card having at least one clear transparent slot extending longitudinally of said card for viewing said computer output, and said data record being positioned on an area below said transparent slot.

10. The device of claim 9 wherein said area below said transparent slot is opaque for masking out non-selected computer output.

11. A device for aiding in the interpretation of differently formatted printed computer output records each consisting of a plurality of fields of data comprising;

a group of data records inscribed on said device each being in a different predetermined format corresponding to said differently formatted computer output records so that each of said data records aligns with and identifies data fields in a selected single row of said computer output records having a format corresponding to the format of said each data record when said device is positioned to match one of said data records with one of said computer output records, each of said data records including unique predetermined eyecatcher data to match against corresponding unique eyecatcher data in said computer output records, designator data inscribed on said device and associated with predetermined fields of each of said data records, and an information section for interpreting data in said computer output records as identified by said designator data.

12. The device of claim 11 wherein said device comprises a flexible sheet member and said data records being inscribed along the edges of said member.

13. The device of claim 11 wherein said device comprises a flexible card having a plurality of clear transparent slots spaced from each other and extending longitudinally of said card for viewing different portions of said computer output records, and each data record of said group of data records being positioned on an area below a corresponding one of said plurality of transparent slots.

* * * * *

UNITED STATES PATENT AND TRADEMARK OFFICE

CERTIFICATE OF CORRECTION

PATENT NO. : 4,549,500

DATED : October 29, 1985

INVENTOR(S) : A. M. Lowin et al

It is certified that error appears in the above-identified patent and that said Letters Patent is hereby corrected as shown below:

Claim 6, line 48 Delete "interpretating" and substitute therefor --interpretation--.

Signed and Sealed this

Thirtieth Day of December, 1986

*Attest:*

DONALD J. QUIGG

*Attesting Officer*

*Commissioner of Patents and Trademarks*